US011534749B2

(12) United States Patent
Kaneko et al.

(10) Patent No.: US 11,534,749 B2
(45) Date of Patent: Dec. 27, 2022

(54) SAFETY CABINET, AND VIBRATION DAMPING MECHANISM FOR FAN FILTER UNIT

(71) Applicant: Hitachi Industrial Equipment Systems Co., Ltd., Tokyo (JP)

(72) Inventors: Takeshi Kaneko, Tainai (JP); Hirotoshi Sato, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 386 days.

(21) Appl. No.: 16/627,930

(22) PCT Filed: Dec. 26, 2018

(86) PCT No.: PCT/JP2018/047826

§ 371 (c)(1),
(2) Date: Dec. 31, 2019

(87) PCT Pub. No.: WO2019/207841

PCT Pub. Date: Oct. 31, 2019

(65) Prior Publication Data

US 2021/0146348 A1 May 20, 2021

(30) Foreign Application Priority Data

Apr. 24, 2018 (JP) ..... JP2018-083429

(51) Int. Cl.

| | |
|---|---|
| ***F24F 3/163*** | (2021.01) |
| ***B01L 1/04*** | (2006.01) |
| ***F24F 7/06*** | (2006.01) |

(52) U.S. Cl.

CPC ..... *B01L 1/04* (2013.01); *F24F 7/06* (2013.01); *B01L 2200/14* (2013.01); *B01L 2300/10* (2013.01)

(58) Field of Classification Search

None

See application file for complete search history.

(56) References Cited

U.S. PATENT DOCUMENTS 4,723,480 A * 2/1988 Yagi ..... F24F 3/163 454/60
5,487,768 A * 1/1996 Zytka ..... B01D 46/0039 55/385.2

(Continued)

FOREIGN PATENT DOCUMENTS

JP 3-271645 A 12/1991
JP 7-24437 U 5/1995

(Continued)

OTHER PUBLICATIONS

International Search Report (PCT/ISA/210) issued in PCT Application No. PCT/JP2018/047826 dated Feb. 26, 2019 with English translation (10 pages).

(Continued)

*Primary Examiner* — Paul S Hyun

(74) *Attorney, Agent, or Firm* — Crowell & Moring LLP

(57) ABSTRACT

A biosafety cabinet includes an operation, an operation space, a front plate, an operation opening, a vibration damping mechanism and an exhaust. The vibration damping mechanism is a mechanism that floats an operation object, which is disposed in the operation space, from the operation stage. The vibration damping mechanism includes a table which supports the operation object, and a magnet which is disposed in the operation stage. The vibration damping mechanism is a mechanism that floats the operation object from the operation stage by using a magnetic force.

2 Claims, 21 Drawing Sheets

(56) References Cited

U.S. PATENT DOCUMENTS

| | | | | |
|---|---|---|---|---|
| 2017/0232434 | A1* | 8/2017 | Goto | F24F 7/06 422/565 |
| 2018/0001315 | A1 | 1/2018 | Kaneko et al. | |
| 2018/0161835 | A1 | 6/2018 | Liebsch | |

FOREIGN PATENT DOCUMENTS

| | | | | |
|---|---|---|---|---|
| JP | 2003-269763 | A | 9/2003 | |
| JP | 2005-98325 | A | 4/2005 | |
| JP | 4255689 | B2 | 4/2009 | |
| JP | 2012-220105 | A | 11/2012 | |
| JP | 2016-165249 | A | 9/2016 | |
| JP | 2017-78527 | A | 4/2017 | |
| JP | 2018-510065 | A | 4/2018 | |
| WO | WO-2016146315 | A1 * | 9/2016 | B01L 1/00 |

OTHER PUBLICATIONS

Japanese-language Written Opinion (PCT/ISA/237) issued in PCT Application No. PCT/JP2018/047826 dated Feb. 26, 2019 (eight (8) pages).

English translation of Chinese-language Office Action issued in Chinese Application No. 201880040367.2 dated Jun. 30, 2021 (nine (9) pages).

* cited by examiner

SAFETY CABINET, AND VIBRATION DAMPING MECHANISM FOR FAN FILTER UNIT

TECHNICAL FIELD

The present invention relates to a biosafety cabinet that is equipment for realizing a safe operation environment to handle microorganisms, pathogens, or the like, and a vibration damping mechanism for a fan filter unit which includes a rotating unit therein.

BACKGROUND ART

In the related art, when microorganisms, pathogens, or the like are handled, a biosafety cabinet is used to safely perform an operation by maintaining an inside purity and physically isolating the microorganisms and pathogens being handled from the human and the environment.

Techniques disclosed in Patent Documents 1 and 2 are known as the biosafety cabinet.

Patent Document 1 discloses a biosafety cabinet that exhausts air outdoors through open type duct connection, in which when there occurs a possibility that a defect occurs with an outdoor exhaust duct system and the exhaust air of the biosafety cabinet which contains a small amount of volatile noxious substances leaks from an opening portion of an open type duct to a laboratory, the biosafety cabinet issues an alarm.

Patent Document 2 discloses a technique where a display device such as a monitor screen provided in a biosafety cabinet is disposed at a position where the display device is not affected by the diffused reflection of light from a fluorescent lamp or aging by irradiation from a sterilization lamp and does not become a resistance to an airflow path when an operator performs an operation using the biosafety cabinet while checking a standard operation procedure or specimen data, the display device is also protected from a decontamination operation, and dirt is prevented from adhering to a display related part.

CITATION LIST

Patent Document

Patent Document 1: JP 2017-78527 A
Patent Document 2: JP 2016-165249 A

SUMMARY OF THE INVENTION

Problems to be Solved by the Invention

The biosafety cabinet includes a rotating unit called a fan filter unit (FFU) including a fan which is driven to rotate by a motor. The biosafety cabinet includes a built-in vibration generation source.

In the related art, in the adjustment of a pharmaceutical solution, or the like which is an operation in the biosafety cabinet, the vibration of the fan is not a major problem; however, when a microscope which is an operation object is installed in an operation space and the number of cultured tissues or cells on a Petri dish is counted, the microscope sways due to a tiny vibration, and thus an image from the microscope looks blurry, the counting cannot be accurately performed, and the like, which are new problems.

Patent Document 1 and Patent Document 2 do not disclose any technique regarding the dampening of vibration from the vibration generation source of the FFU.

An object of the present invention is to provide a biosafety cabinet that is capable of preventing a reduction in operability by vibration, and a vibration damping mechanism for a fan filter unit.

Solutions to Problems

According to a preferable example of the present invention, there is provided a biosafety cabinet including: an operation stage on which an operation is performed; an operation space in which an operator performs an operation; a front plate that is disposed in a front surface of the operation space; an operation opening that is connected to the operation space; exhaust means for taking air in from the operation opening and exhausting air in the operation space outside the biosafety cabinet through air purification means; and a vibration damping mechanism.

According to another preferable example of the present invention, there is provided a vibration damping mechanism in a fan filter unit that includes a rotating unit for blowing air to an external device, and a housing, the mechanism includes a mechanism that prevents vibration from the rotating unit from being transmitted from the housing to the external device.

Effects of the Invention

According to the present invention, it is possible to prevent a reduction in operability by vibration.

MODE FOR CARRYING OUT THE INVENTION

Hereinafter, examples will be described with reference to FIGS. 1 to 16.

Example 1

Figure 1:
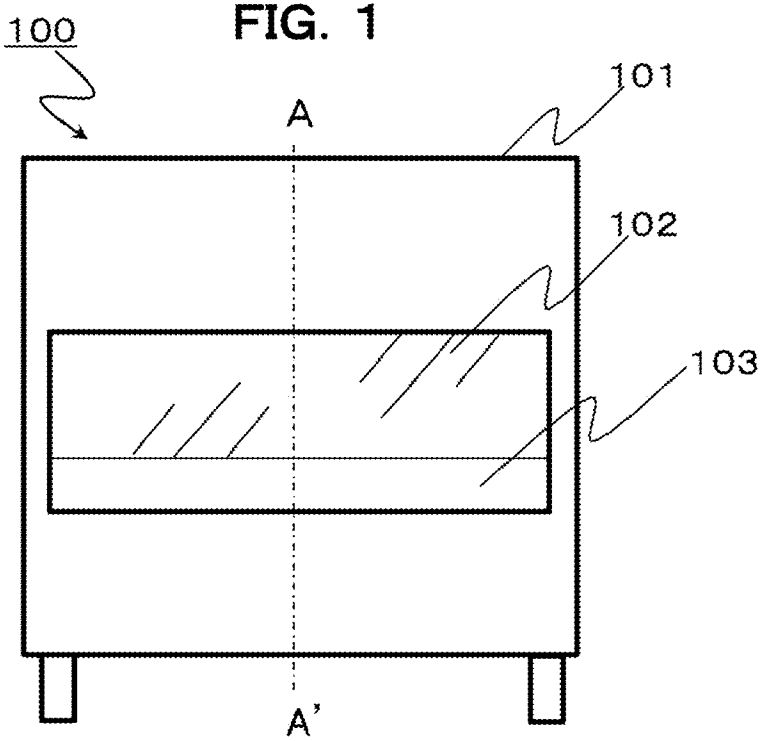
FIG. 1 is a schematic front view of a biosafety cabinet in Example 1.
Figure 2:
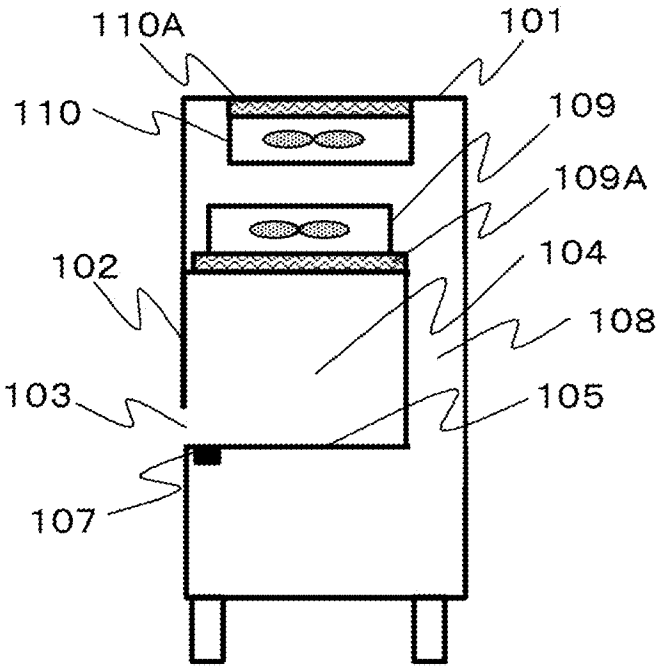
FIG. 2 is a schematic side view of the biosafety cabinet when a cross section A-A' in FIG. 1 is seen from right.

FIG. 1 illustrates a schematic front view of a biosafety cabinet. In addition, FIG. 2 illustrates a schematic side view of the biosafety cabinet when a cross section A-A' in FIG. 1 is seen from right.

An opening is provided in a central area of a housing 101 of a biosafety cabinet 100, and an operation space 104 is provided therebehind. A front plate 102 is provided on a front surface side of the operation space 104 so as to block an upper portion of the opening, an operation opening 103 is provided on a lower side thereof, and an operator inserts the hands into the operation space 104 from the operation opening 103 to perform an operation. The front plate 102 is formed of a transparent material such as glass, and the operator can see an operation through the front plate.

An operation stage 105 which is substantially planar is provided on a bottom surface of the operation space 104, and the operator performs an operation on the operation stage. An air intake port 107 leading downward is provided close to the operation opening 103 on a front side of the operation stage 105. The air intake port 107 is formed of, for example, a slit that extends along the operation opening 103 in a rightward and leftward direction of the housing 101. A back flow path 108 leading from the air intake port 107 to an upper portion of the housing 101 is provided on a back surface side of the operation space 104.

An air blow side fan filter unit (FFU) 109 is provided above the operation space 104. The air blow side FFU 109 is formed of a fan which is driven to rotate by a motor and is air blowing means, and a filter which removes microparticles, for example, a HEPA filter 109A which is air purification means. The air blow side FFU 109 blows purified air, which is free from the microparticles, into the operation space 104. An exhaust side fan filter unit (FFU) 110, which includes a fan that is driven to rotate by a motor and is air blowing means, is provided in the upper portion of the housing 101, and removes microparticles from a portion of air with the filter, for example, a HEPA filter 110A to exhaust the portion of air outside the device.

Figure 3:
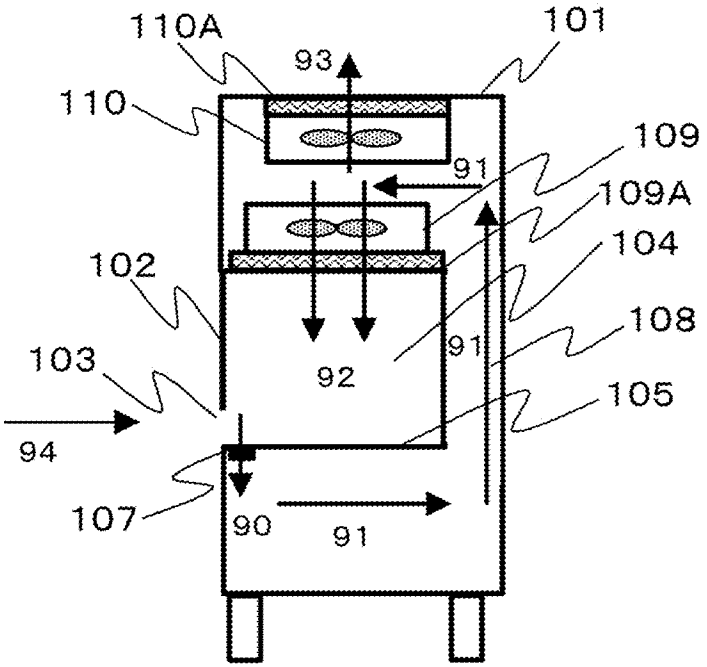
FIG. 3 is a schematic side view of the biosafety cabinet illustrating an air flow with the arrows.

In FIG. 3, an air flow when the biosafety cabinet operates is illustrated with the arrows. An air 90 which is taken in from the air intake port 107 on a front surface side of the operation stage 105 is blown, as shown with reference sign 91, into the operation space 104 from the air blow side FFU 109 through a lower portion of the housing 101, the back flow path 108, and the upper portion of the housing 101. Since purified air from which microparticles are removed by the HEPA filter 109A of the air blow side FFU 109 is blown into the operation space 104, the operation space 104 is maintained in a purified state.

At the time, if only an air flow denoted by reference sign 92 is blown into the operation space 104, air in the operation space leaks outside, which is a concern. For this reason, the exhaust side FFU 110 is provided, and a portion of air is discharged outside through the HEPA filter 110A. Therefore, a pressure in the operation space 104 decreases, and an air flow 94 to be introduced from outside to inside through the operation opening 103 in a lower part of the front plate 102 is formed. If the air flow 94 flows directly into the operation space 104, the purity of the operation space decreases.

However, since all of the air 94 flowing in from the operation opening 103 and the majority of the air 92 blown into the operation space 104 are taken in from the air intake port 107 by properly controlling the air volume of the air flow 92 which is blown into the operation space 104 from the air blow side FFU 109 and the air volume of an air flow 93 which is exhausted outside from the exhaust side FFU 110, owing to the air flow 92 blown into the operation space 104, an atmospheric barrier (air barrier) is formed to prevent the air 94 from flowing into the operation space 104 from the operation opening 103.

Therefore, it is possible to realize an equilibrium where the operation space 104 is not contaminated by air from outside and no air leaks outside before the inside is purified. In addition, therefore, even though the operator inserts the hands into the operation space 104 through the operation opening 103 to perform an operation, it is possible to realize the maintenance of the purity and the prevention of contamination.

Figure 4:
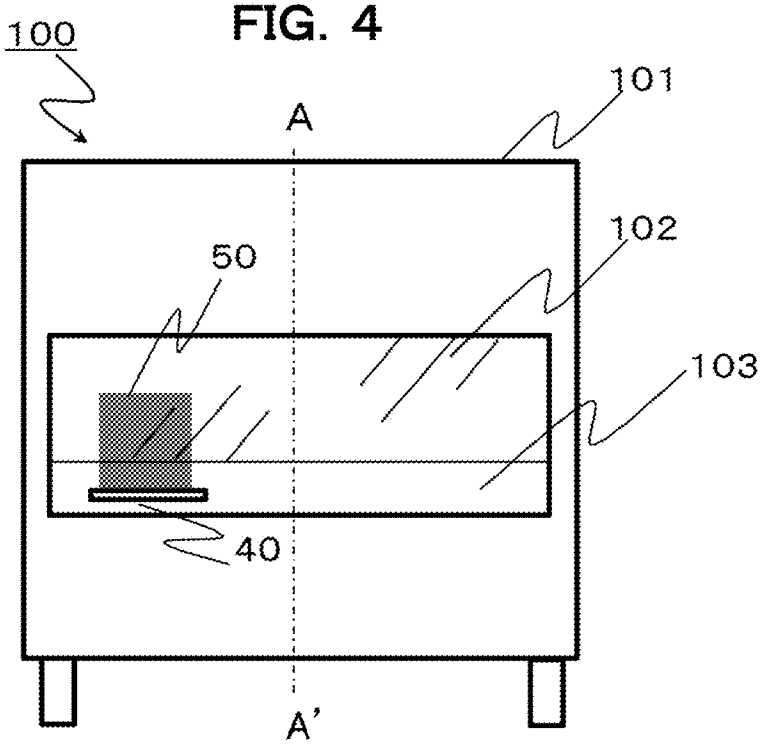
FIG. 4 is a schematic front view of the biosafety cabinet for describing Example 1.
Figure 5:
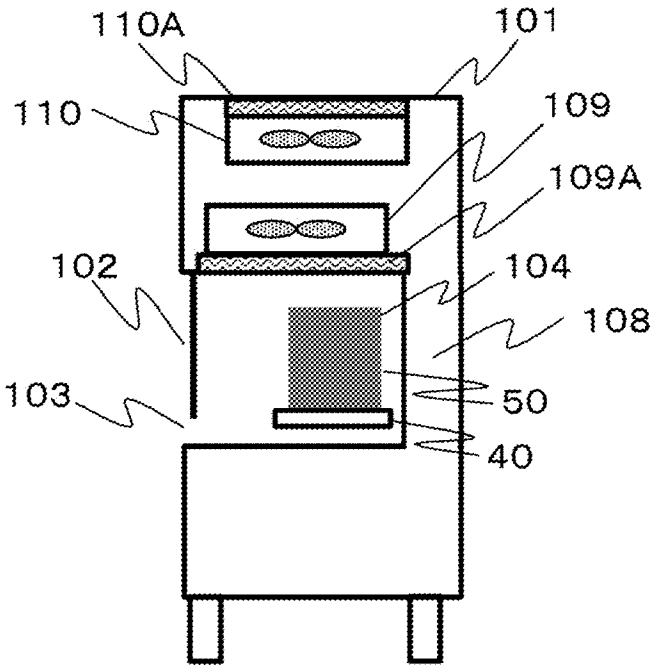
FIG. 5 is a schematic side view of the biosafety cabinet when the cross section A-A' in FIG. 4 is seen from right.

FIG. 4 is a schematic front view of the biosafety cabinet 100 for describing Example 1. FIG. 5 illustrates a schematic side view of the biosafety cabinet when the cross section A-A' in FIG. 4 is seen from right.

Example 1 is an example where a microscope 50 which is an operation object is floated from the operation stage 105 of the biosafety cabinet. In Example 1, the configuration where this floating is performed by air will be described.

The microscope is floated as in the air hockey by ejecting air from an air ejection port toward the microscope 50 which is placed on a floatation table 40 disposed on the operation stage 105.

Since the air is required to have a high pressure, when the microscope 50 is used, purified air may be introduced from a high pressure tank and ejected.

Figure 6:
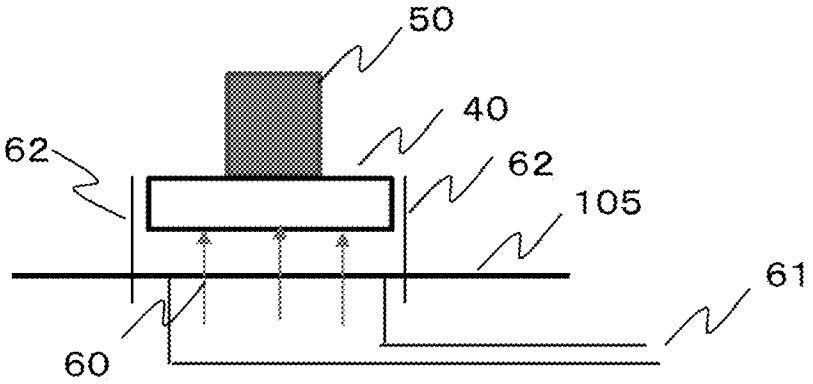
FIG. 6 is a view describing a configuration around a microscope in Example 1.

FIG. 6 is a view describing a configuration around the microscope 50 in Example 1. The air ejection port (a plurality of the air ejection ports are desirable) is provided in a region on the operation stage 105 which corresponds to the microscope 50, and the microscope 50 is floated as in the air hockey. Horizontal movement restriction members 62 for restricting a movement in a lateral direction are provided from the operation stage 105 in a height direction.

A floatation air 60 is purified air which is introduced from a floatation air pipe 61. It is possible to allow the floatation air 60 to flow between side surfaces of the floatation table 40 and the horizontal movement restriction members 62, and it is possible to impart the effect of restricting vibration in a rightward and leftward direction to the floatation air 60 by setting the distance between the horizontal movement restriction members 62 to be larger than the width of the floatation table 40. Since the floatation air 60 is required to have a high pressure, only when the microscope 50 is used, purified air may be introduced from the high pressure tank and ejected.

Example 2

Figure 7A:
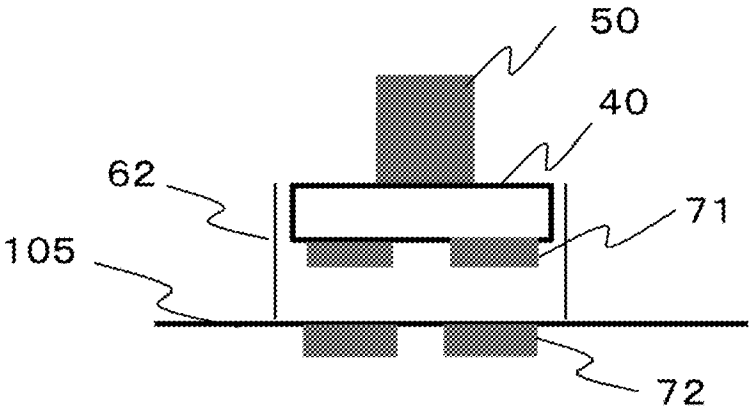
FIGS. 7A to 7C are views of a configuration around an operation object for describing Example 2.
Figure 7B:
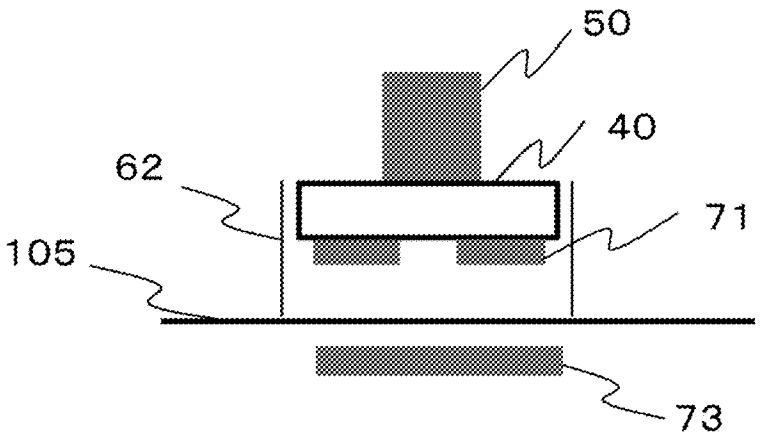
Figure 7C:
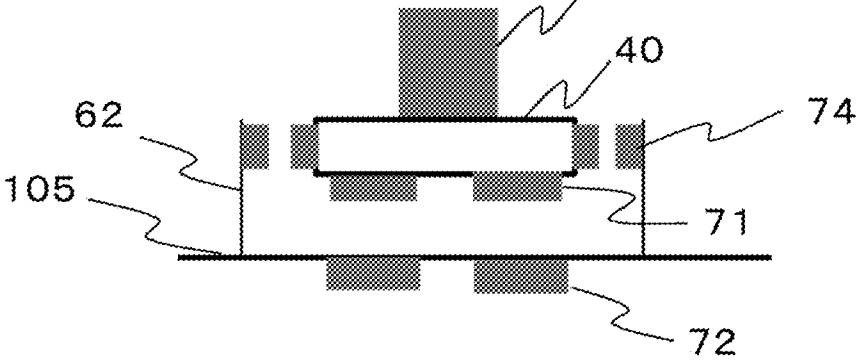

FIG. 7 is a view of a configuration around the microscope, which is an operation object, for describing Example 2. Example 2 is another example where the microscope 50 which is an operation object is floated from the operation stage 105 of the biosafety cabinet. In Example 2, the configuration where this floating is performed by magnets will be described.

In FIG. 7(*a*), a permanent magnet (A) 71 is disposed on a bottom surface of the floatation table 40 on which the microscope 50 is placed, and a permanent magnet (B) 72 is disposed on an upper surface of the operation stage. The permanent magnets are disposed and magnetized with the same polarity so as to generate a repulsive force.

FIG. 7(*b*) illustrates a configuration example where the permanent magnet (A) 71 is disposed on the bottom surface of the floatation table 40 on which the microscope 50 is placed, and an electromagnet 73 is disposed in the operation stage 105. The electromagnet 73 is turned on and off by operating a button provided in the biosafety cabinet 100.

Current is controlled to flow to a coil of the electromagnet 73 such that the polarities of the electromagnet 73 and the permanent magnet (A) 71 which face each other become the same polarity.

When the operation stops, the current attenuates gradually. The gradual attenuation is performed to prevent that the floatation force dissipates rapidly and an impact is applied to the microscope 50.

In addition, an impact absorption member having flexibility may be provided between the floatation table 40 and the operation stage 105 to be separated therefrom during floating and come into contact therewith during descending. The impact absorption member is provided to prevent an impact from being applied to the microscope 50.

As illustrated in FIG. 7(*c*), in a case where the horizontal movement restriction member 62 is provided and permanent magnets (C) 74 are magnetized with the same polarity and are disposed in both of the floatation table 40 and the horizontal movement restriction member 62 to face each other, the prevention of vibration in the rightward and leftward direction is also realized.

In this case, since the right and left magnets are not required to support the weight of the floatation table 40 or the microscope 50, it is possible to use the right and left magnets which have smaller sizes or weaker magnetic forces than that of the permanent magnet (A) 71 or the permanent magnet (B) 72 for floatation. The same applies to a case where as illustrated in FIG. 7(*b*), the electromagnet 73 is used.

Example 3

Figure 8A:
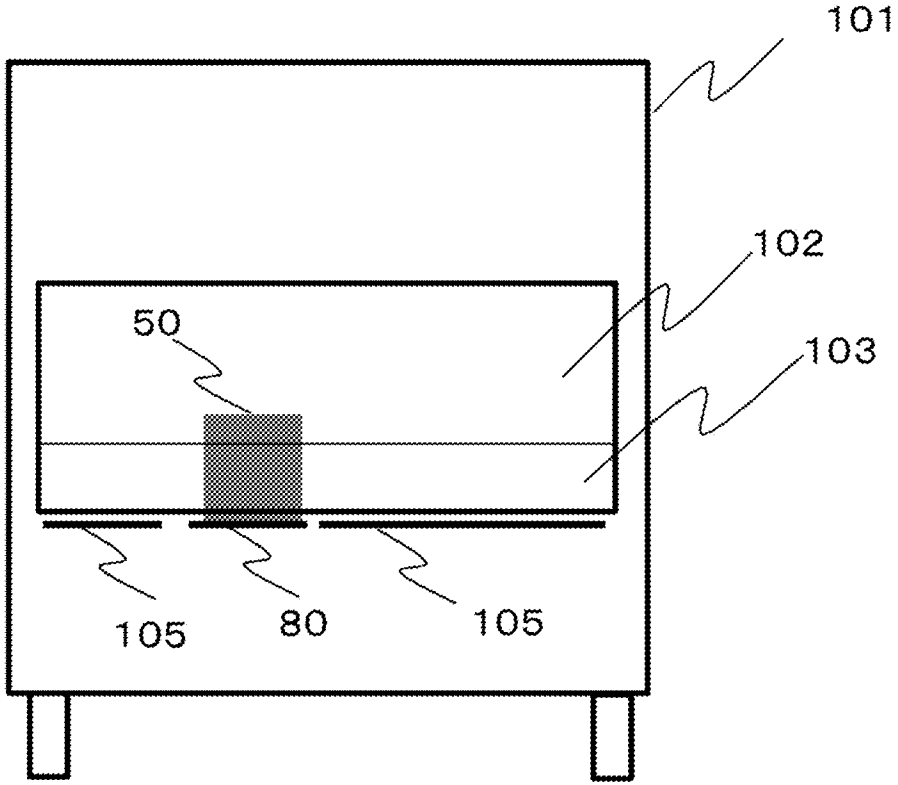
FIGS. 8A and 8B are configuration views of the biosafety cabinet describing Example 3.
Figure 8B:
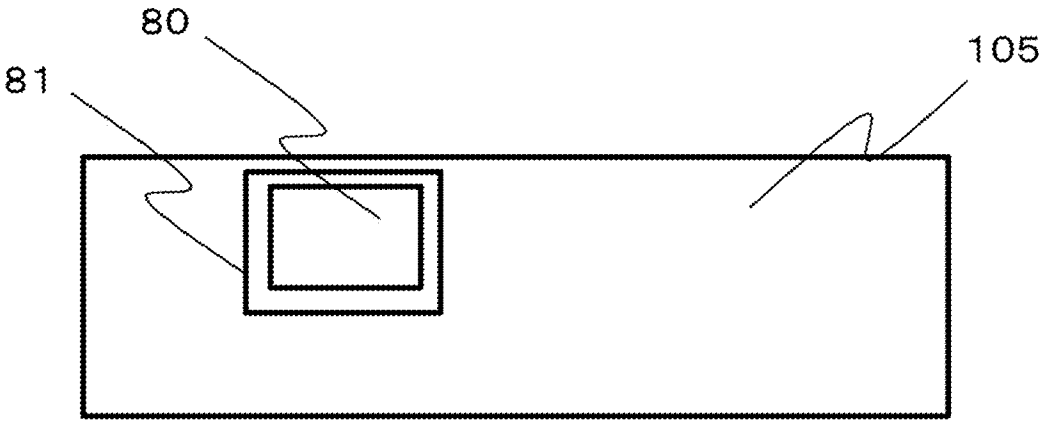

FIG. 8 is a configuration view of the biosafety cabinet describing Example 3. FIG. 8(*a*) is a schematic front view of the biosafety cabinet 100 for describing Example 3. FIG. 8(*b*) illustrates a top view when the operation stage 105 in FIG. 8(*a*) is seen from above. In Example 3, the operation stage 105 is divided, and a region where the microscope 50 is mounted is a region which is located on an operation stage 80 and is separated from other regions of the operation stage 105. With the above-described configuration, vibration from the other regions is prevented from being transmitted to the operation stage 80 on which the microscope 50 is mounted and which is separated therefrom.

A connection member 81 which is a deformable material such as rubber is disposed in a surrounding region of the operation stage 105. In a case where the operation stage 80 which is separated is floated by air or magnets, it is possible to further improve the vibration damping performance.

Figure 9A:
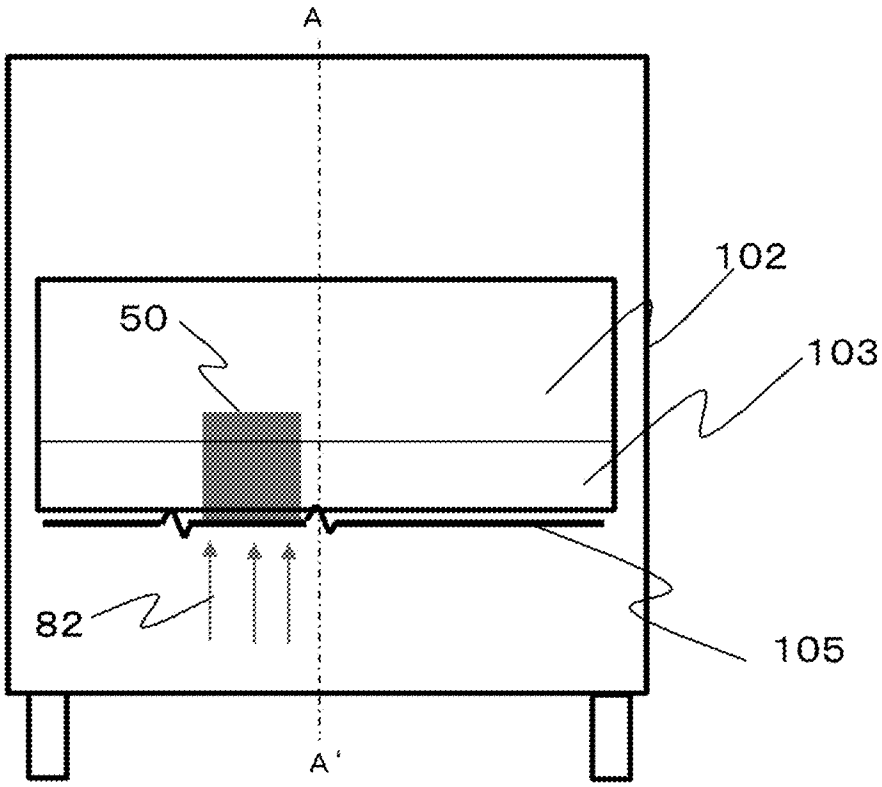
FIGS. 9A and 9B are views describing a configuration where an operation stage is floated in Example 3.
Figure 9B:
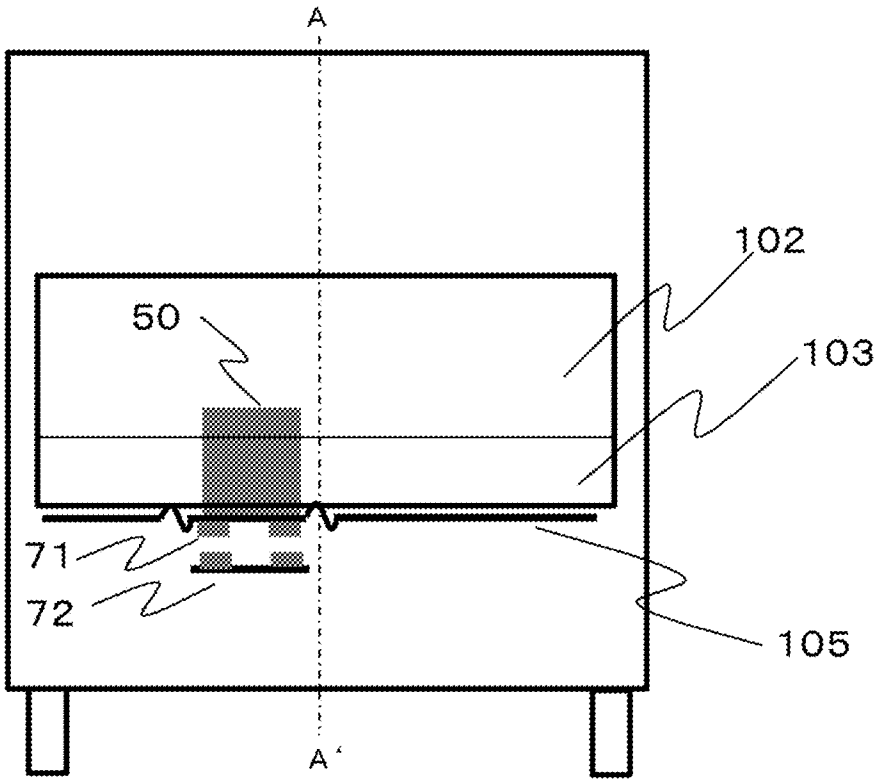

FIG. 9 is a view describing a configuration where the operation stage 105 is floated in Example 3. FIG. 9(*a*) is a view describing a case where air is used to float the operation stage 105 in Example 3. When a processing chamber is sealed to not allow floatation air to flow thereinto, a return air 82 may be used as the floatation air. In this case, in order to be able to form a strong upward air flow for floatation in the region, a tapered introduction pipe may be installed in a return path, and the return air 82 may be blown from below to above, specifically, from the tapered introduction pipe to the operation stage 105 where the microscope 50 is placed.

FIG. 9(*b*) is a view describing a case where magnets are used to float the operation stage 105 in Example 3. In this example, the permanent magnet (A) 71 is disposed on a lower surface of the operation stage 105, and the permanent magnet (B) 72 is disposed on a surface facing the operation stage 105. The operation stage 105 can be floated by the repulsive force of the magnets.

Example 4

Figure 10A:
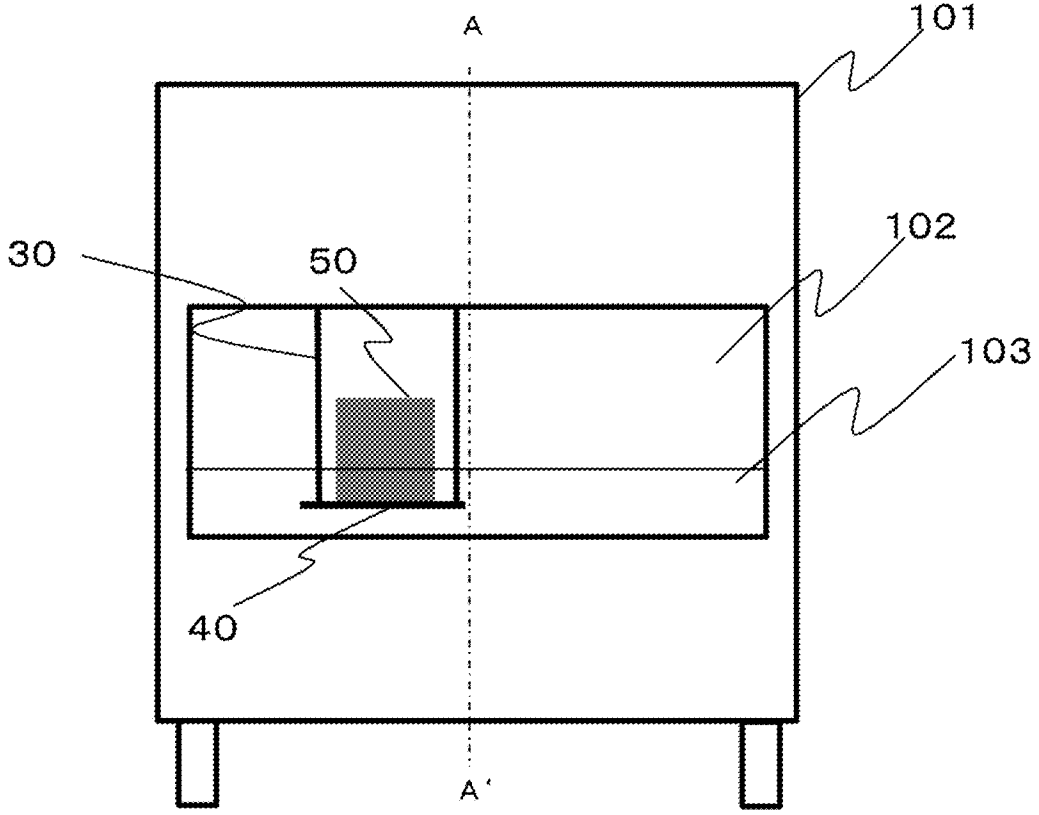
FIGS. 10A and 10B are configuration views of the biosafety cabinet describing Example 4.
Figure 10B:
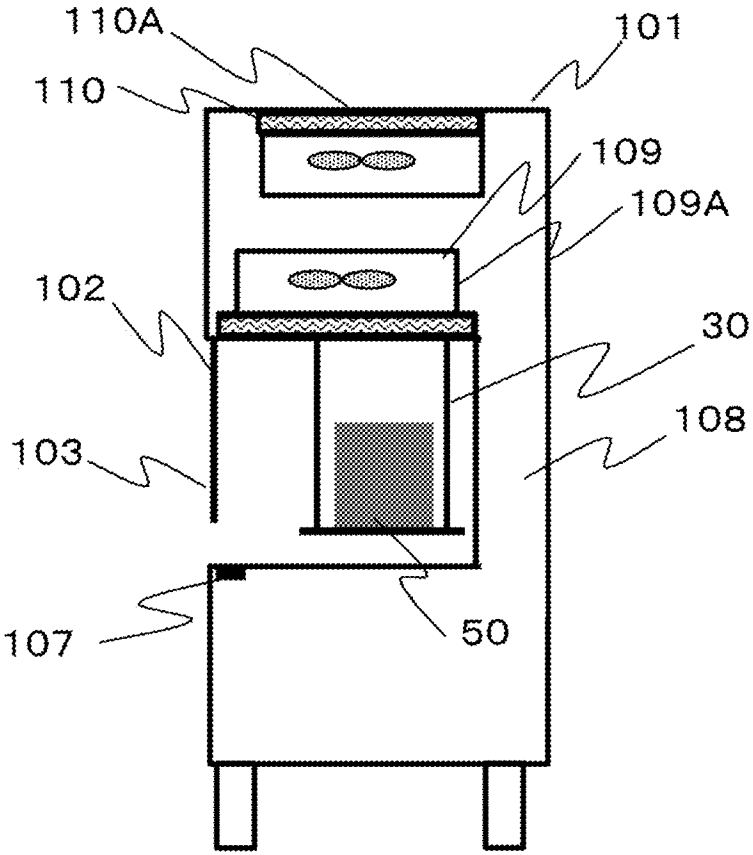

FIG. 10 is a configuration view of the biosafety cabinet describing Example 4. FIG. 10(*a*) is a schematic front view of the biosafety cabinet 100 for describing Example 4. FIG. 10(*b*) illustrates a schematic side view of the biosafety cabinet 100 when the cross section A-A' in FIG. 10(*a*) is seen from right. FIG. 10 illustrates a configuration example where the floatation table 40 for the microscope 50 which is an operation object is suspended by a wire 30. In Example 4, since a vibration transmission path is very thin, it is possible to greatly reduce the amount of vibration transmitted to the microscope 50.

Example 5

Figure 11:
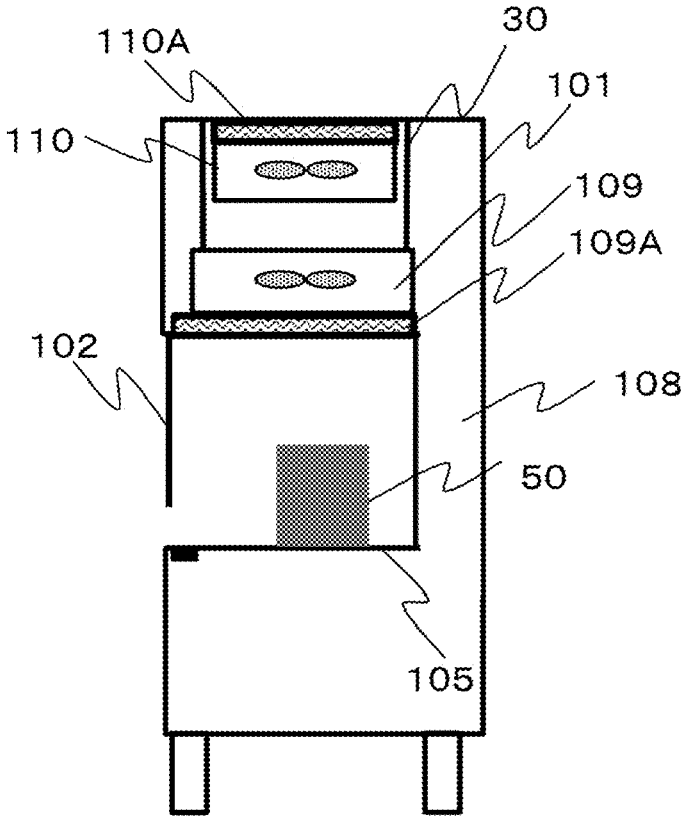
FIG. 11 is a schematic side view of a biosafety cabinet 100 for describing Example 5.

FIG. 11 is a schematic side view of the biosafety cabinet 100 for describing Example 5. Example 5 is an example where the air blow side FFU 109 which is a vibration generation source is suspended on a ceiling portion of the housing 101 by the wire 30. It is possible to reduce vibration which is transmitted from the air blow side FFU 109 into the biosafety cabinet 100.

Figure 12:
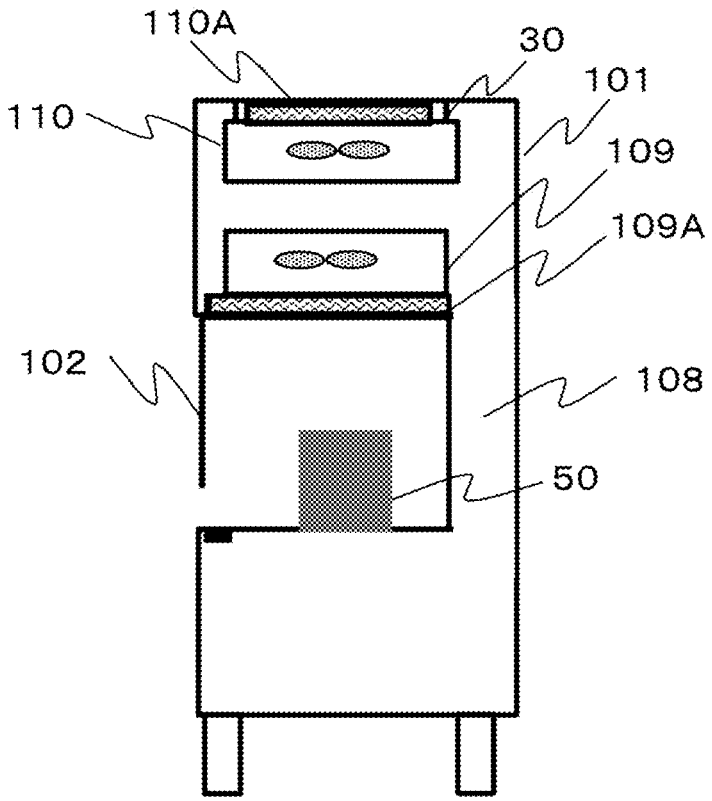
FIG. 12 is a view describing an example where an exhaust side FFU is suspended on a ceiling portion of a housing by a wire.

FIG. 12 is a view describing an example where the exhaust side FFU 110 is suspended on the ceiling portion of the housing 101 by the wire 30. It is possible to reduce vibration which is transmitted from the exhaust side FFU 110 into the biosafety cabinet 100.

Figure 13:
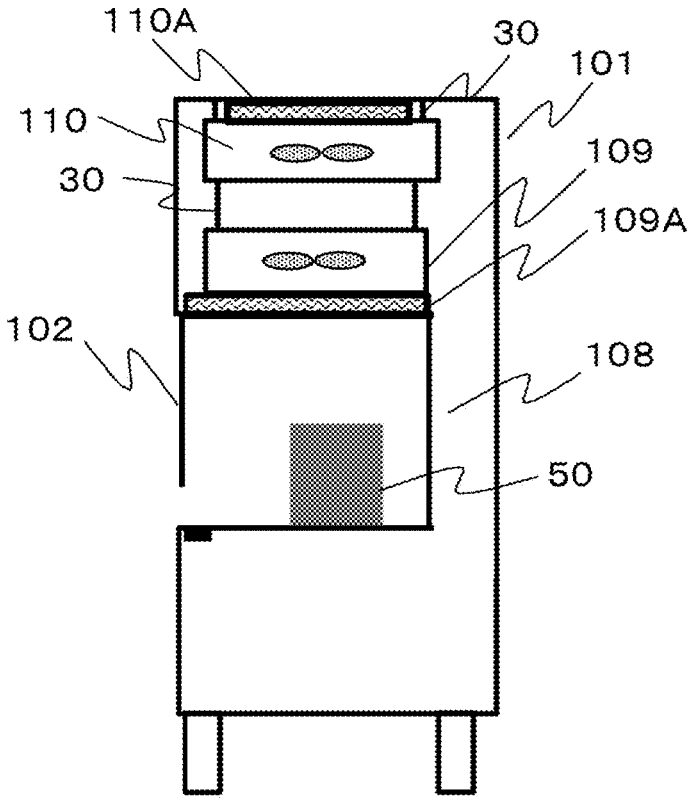
FIG. 13 is a view describing an example where an air blow side FFU is suspended via the exhaust side FFU.

In addition, both of the air blow side FFU 109 and the exhaust side FFU 110 may be suspended by the wire 30 or the like. In addition to the configuration where both are suspended by the wires 30 which are independent from each other, as illustrated in FIG. 13, the air blow side FFU 109 may be suspended via the exhaust side FFU 110.

In Example 5, with a simple mechanism, it is possible to better dampen vibration which is transmitted to the operation stage 105 than a case where the operation object is floated.

Example 6

Figure 14:
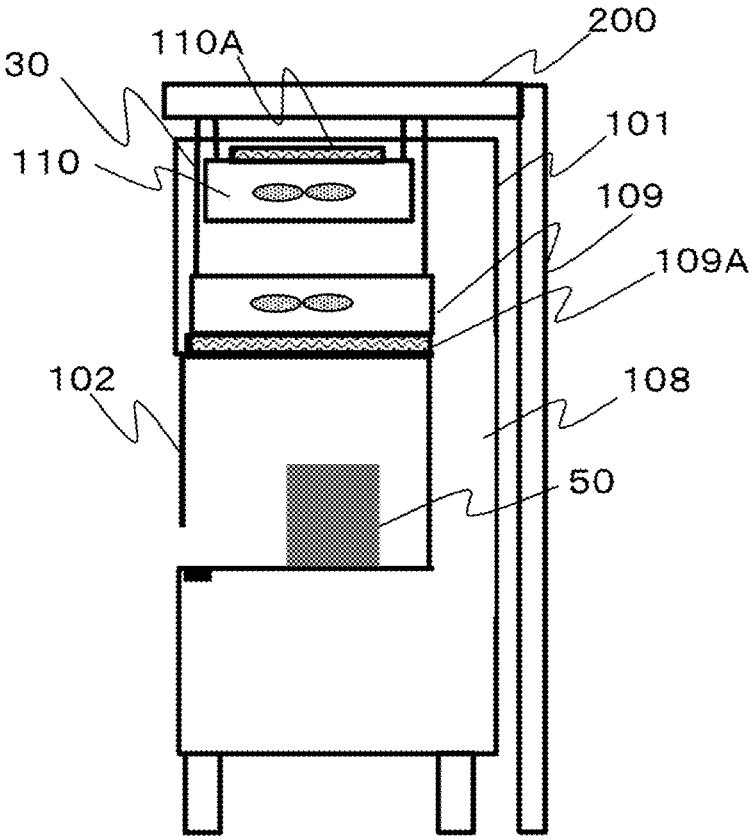
FIG. 14 is a schematic side view of the biosafety cabinet for describing Example 6.

FIG. 14 illustrates a schematic side view of the biosafety cabinet 100 for describing Example 6.

FIG. 14 illustrates an example where the FFU which is a vibration generation source is suspended on a support arm 200, which is provided outside the biosafety cabinet 100, by the wire 30. In FIG. 14, the support arm 200 which is separated from the housing 101 is provided, and the FFU is suspended from the support arm 200 by the wire 30 or the like.

Figure 15:
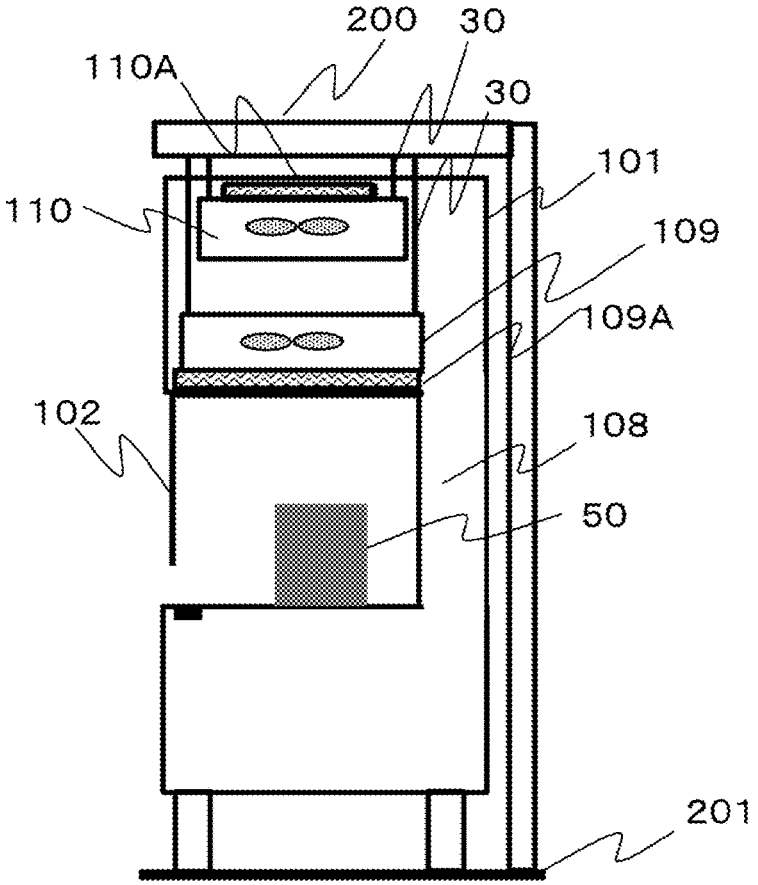
FIG. 15 is a schematic side view of the biosafety cabinet where a lower plate is disposed on a lower side of a support arm.

FIG. 15 illustrates a schematic side view of the biosafety cabinet 100 where a lower plate 201 is disposed on a lower side of the support arm 200. The support arm 200 is fixed by providing the lower plate 201 on the lower side of the support arm 200 and disposing the lower plate 201, which becomes a floor platform, below the biosafety cabinet 100. The position of the support arm 200 is firmly fixed by the weight of the biosafety cabinet 100 itself; and thereby the relocation thereof is facilitated, and it is possible to realize a simple and sufficient fixation.

Figure 16:
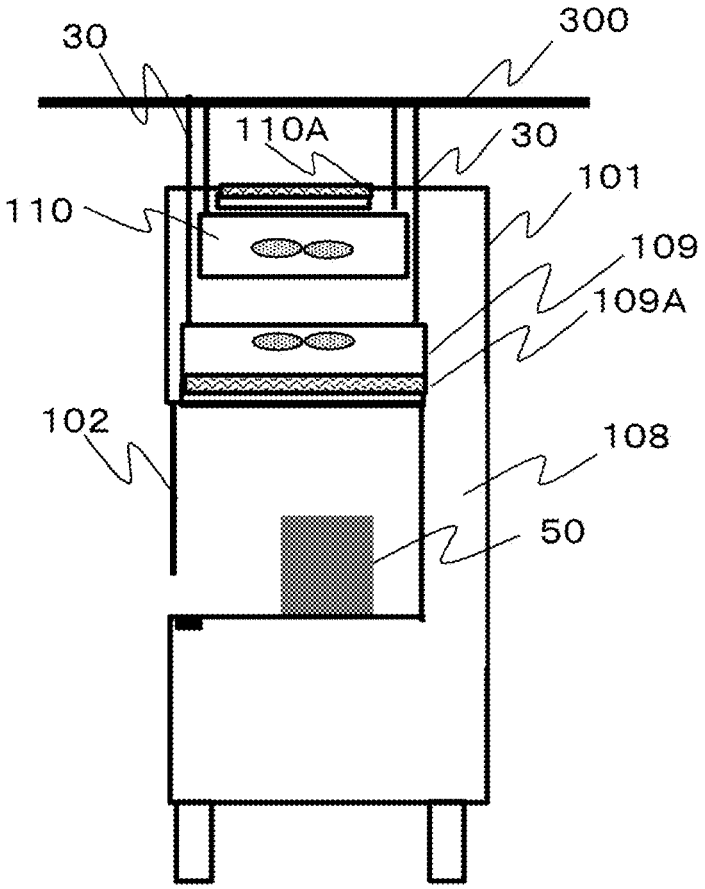
FIG. 16 is a schematic side view of the biosafety cabinet 100 where an FFU is suspended from a ceiling.

FIG. 16 illustrates a schematic side view of the biosafety cabinet 100 where the FFU's are suspended from a ceiling 300 of a facility which is provided above the biosafety cabinet 100, the facility accommodating the biosafety cabinet 100, by the wire 30 or the like. According to the example illustrated in FIG. 16, since the vibration transmission path is clearly separated from the biosafety cabinet 100 including the vibration generation sources, it is possible to realize substantially no vibration.

In the above-described examples, the vibration damping mechanisms targeted for the biosafety cabinet have been described, and there are a semiconductor production device and the like as target devices to which air is blown from the FFU. In order to prevent vibration from the FFU which is a vibration generation source, as will be described below, a vibration damping mechanism is configured to prevent vibration from being transmitted from the rotating unit of the fan filter unit (FFU) to an external device.

For example, a mechanism which floats the rotating unit in a housing accommodating the FFU is provided. In this case, since it is difficult to obtain air, it is preferable that this floating is performed by magnetism.

Subsequently, the rotating unit in the housing of the FFU is suspended by a wire. The housing itself of the FFU or the rotating unit therein may be configured to be suspended from outside by the wire. As described above, the installation to the support arm, the suspension from the ceiling, or the like is applicable as a suspension method.

REFERENCE SIGNS LIST

30 Wire
40 Floatation table
50 Microscope
100 Biosafety cabinet
101 Housing
102 Front plate
103 Operation opening
104 Operation space
105 Operation stage
107 Air intake port
108 Back flow path
109 Air blow side FFU
109A Air blow side HEPA filter
110 Exhaust side FFU
110A Exhaust side HEPA filter

The invention claimed is:

1. A biosafety cabinet comprising:

an operation stage above which an operation is performed;

an operation space in which an operator performs an operation;

a front plate that is disposed in a front surface of the operation space;

an operation opening that is connected to the operation space;

exhaust means for taking air in from the operation opening and exhausting air in the operation space outside the biosafety cabinet through air purification means; and a vibration damping mechanism, wherein the vibration damping mechanism is a mechanism that floats an operation object, which is disposed in the operation space, from the operation stage, the vibration damping mechanism includes a table which supports the operation object, and a magnet which is disposed in the operation stage, and the vibration damping mechanism is a mechanism that floats the operation object from the operation stage by using a magnetic force.

2. The biosafety cabinet according to claim 1, wherein the operation stage is divided, and a connection member is disposed between one part of the operation stage on which an operation object is mounted and the other part of the operation stage to connect the parts of the operation stage to each other.

* * * * *